US005860228A

United States Patent [19]

Bathum

[11] Patent Number: 5,860,228

[45] Date of Patent: Jan. 19, 1999

[54] ALL PURPOSE NUBBED CLEAT FOR SHOES AND OTHER NON-SLIP APPLICATIONS

[75] Inventor: Dale Bathum, Mercer Island, Wash.

[73] Assignee: Bite, LLC, Redmond, Wash.

[21] Appl. No.: 882,516

[22] Filed: Jun. 25, 1997

Related U.S. Application Data

[63] Continuation-in-part of Ser. No. 70,581, May 12, 1997, Pat. No. Des. 396,949.

[51] Int. Cl.[6] ..... A43C 15/02

[52] U.S. Cl. ..... 36/127; 36/134; 36/67 D

[58] Field of Search ..... 36/127, 134, 67 D, 36/59 R, 59 B

[56] References Cited

U.S. PATENT DOCUMENTS

| | | | |
|---|---|---|---|
| 39,575 | 8/1863 | Hyatt et al. . | |
| D. 371,896 | 7/1996 | McMullin | D2/962 |
| 461,103 | 10/1891 | Lithgow . | |
| 1,165,235 | 12/1915 | Emery . | |
| 2,491,596 | 12/1949 | Zaleski et al. | 36/59 |
| 2,607,134 | 8/1952 | Langer | 36/59 |
| 2,607,135 | 8/1952 | Langer | 36/59 |
| 2,745,197 | 5/1956 | Holt . | |
| 3,331,148 | 7/1967 | Hollister et al. | 36/67 |
| 3,487,563 | 1/1970 | Austin | 36/67 |
| 3,559,310 | 2/1971 | Kiela | 36/7.3 |
| 3,561,140 | 2/1971 | Ludwig . | |
| 3,566,489 | 3/1971 | Morley | 36/67 |
| 3,583,082 | 6/1971 | Jordan, Jr. | 36/59 |
| 3,656,245 | 4/1972 | Wilson | 36/67 |
| 3,672,077 | 6/1972 | Coles | 36/2.5 |
| 3,715,817 | 2/1973 | White et al. | 36/67 |
| 4,014,114 | 3/1977 | Jordan et al. | 36/37 |
| 4,233,759 | 11/1980 | Bente et al. | 36/59 |
| 4,380,878 | 4/1983 | Skaja . | |
| 4,492,047 | 1/1985 | Arff | 36/134 |
| 4,587,748 | 5/1986 | Collins | 36/127 |
| 4,782,604 | 11/1988 | Wen-Shown | 36/127 |
| 5,259,129 | 11/1993 | Deacon et al. | 36/127 |
| 5,367,793 | 11/1994 | Deacon et al. | 36/127 |
| 5,623,774 | 4/1997 | Abbey | 36/134 |

FOREIGN PATENT DOCUMENTS

| | | |
|---|---|---|
| 156642 | 3/1939 | Germany . |
| 25 29 027 | 1/1977 | Germany . |
| 467815 | 12/1951 | Italy . |
| 832081 | 12/1991 | Japan . |
| 24348 | 3/1896 | United Kingdom . |
| 125571 | 4/1919 | United Kingdom . |
| 1378461 | 12/1974 | United Kingdom . |
| 1434282 | 5/1976 | United Kingdom . |
| 2 223 394 | 11/1990 | United Kingdom . |

*Primary Examiner*—Ted Kavanaugh
*Attorney, Agent, or Firm*—Marvin E. Jacobs

[57] ABSTRACT

The invention relates to an all purpose nubbed cleat which when incorporated into the outsole of a shoe or at the bottom end of a cane or walker will enhance their non-slip, non-skid properties without harming the surface in contact with the cleats. The cleat has a cleat body, a plurality of nubs downwardly depending from the lower surface of the cleat body, and a plurality of reinforcing ribs disposed between nubs also on the lower surface of the cleat body. The reinforcing ribs form a grid on the lower surface of the cleat body. The cleat may be fabricated from any suitable low abrasion, durable and resilient material.

14 Claims, 2 Drawing Sheets

ALL PURPOSE NUBBED CLEAT FOR SHOES AND OTHER NON-SLIP APPLICATIONS

CROSS-REFERENCE TO RELATED APPLICATION

This application is a continuation-in-part of application Ser. No. 29/070,581 filed May 12, 1997 now Design U.S. Pat. No. D0396,949.

TECHNICAL FIELD

The present invention relates to an all purpose nubbed cleat which when incorporated, for example, into the outsole of a shoe will enhance its non-slip, non-skid properties during athletic activity but will not harm the floor surfaces which the cleat contacts during non-athletic activities.

BACKGROUND OF THE INVENTION

A plethora of non-slip, non-skid devices exist have been designed for improving the traction of athletic shoes. Most of these devices comprise some form of a stud or group of studs which are attached to the ground engaging portion of the apparatus for which improved traction is being sought, typically shoe outsoles. Some studs are designed to penetrate the ground surface and some are designed to grip without penetrating or otherwise damaging the ground surface. In many of these configurations, the stud or stud assembly is removable and replaceable. Spikes for a conventional golf shoe, for example, are secured to the outsole and distributed over the forepart (ball) of the shoe, over the heel portion of the shoe and generally along opposite sides of the shoe. Additional spikes or cleats may be provided between the opposite sides. The spikes provide a ground gripping means which prevents lateral shifting of the feet, particularly during the act of swinging a golf club.

| List of References | Patentee |
|---|---|
| U.S. Pat. No. | |
| 4,233,759 | Bente |
| 4,782,604 | Wen-Shown |
| 5,367,793) | Deacon et. al. |
| Des. 371,896 | Deacon et. al. |

STATEMENT OF THE PRIOR ART

Wen-Shown (U.S. Pat. No. 4,782,604) describes a golf shoe with a predetermined number of "nails" located at the front end of the shoe, corresponding to the ball portion of the outsole and a predetermined number of nails at the rear end corresponding to the heel portion of the outsole. A plurality of soft cleats is placed between and around the ball and heel portions of the outsole.

Bente (U.S. Pat. No. 4,233,759) describes a sports shoe having a multiplicity of tapered anti-slip cleats provided around the periphery of the outsole of the shoe. Each of these cleats has a plurality of substantially parallel longitudinal ribs and a blunt face, for contact with the ground surface. The blunt faces may have an oblique portion, some inclined forwardly, some inclined rearwardly depending on their position on the outsole.

Brooker (U.K. Patent Specification 1,378,461) describes an improvement to "studs for footwear" wherein the molded plastic stud has a "keying formation". The keying formation consists of a flange having two or more crossing arch formations, either symmetric or asymmetric. In use, the stud penetrates the ground surface and any twisting motion of the shoe is countered by the resistance of the soil acting on the crossing arch formations.

Deacon, et al. (U.S. Pat. No. 5,367,793) describe a replaceable golf shoe cleat or spike, particularly suitable for winter golf play. The cleat is an alternative to the metal spikes used in conventional golf shoes. This cleat is formed generally of a unitary cleat body having a threaded stud axially protruding from the upper surface of a concavo-convex flange for threadably and replaceably attaching to the golf shoe outsole. The bottom or traction surface of the cleat has a plurality of ribs emanating from the center of the flange for developing traction with the turf of the golf course. These ribs may be formed from an arcuate, triangular or essentially rectangular cross section. These cleats are advantageously formed from the same material used to manufacture the outsole of the shoe.

Available devices for improving traction between a shoe, for example, and the contact surface suffer from several shortcomings. Most of the prior art devices incorporate cleats which aggressively penetrate the ground surface (including turf and artificial turf) thus damaging the surface, or even worse, restricting the natural twisting and rotational motion of the foot in such a manner that the foot, ankle, leg or lower back may be injured prior to the release of the cleat by the ground surface. Importantly, damage to the ground surface is of particular concern on golf courses during the winter and rainy seasons. Under these conditions the fairways and greens are highly vulnerable to damage by a penetrating cleat or spike. This is especially critical for grass during the long dormant periods in northern geographic regions. Under such environmental conditions, many golf course superintendents and greens keepers prohibit the use of golf shoes with penetrating spikes and studs.

The Deacon, et. al. patent address the problems associated with spike and studs penetrating the ground surface by eliminating all penetrating components on their cleat and instead providing only a series of small ribs on a cleat that increase the contact area and thus friction with the ground surface. Although their device minimizes damage to the ground surface, it fails to develop the required traction with surfaces that are wet, icy or other consequences resulting from the adverse conditions characteristic of winter climes.

My earlier patent application, Ser. No. 08/633,835 filed Apr. 2, 1996, discloses a novel, all purpose cleat that, when incorporated into suitable footwear, will meet the increased shoe traction demands of most athletic activities. Additionally, the same cleated footwear is appropriate and practical for use outside a sports venue. This earlier application discloses an all purpose cleat comprised of a cleat body having a top surface, a bottom surface, and a periphery; a single downwardly depending spike centrally located on the bottom surface; and a plurality of traction ribs on the bottom surface emanating from a point adjacent to the spike to the periphery of the cleat body. These cleats provide effective traction with ground surfaces typical of a broad variety of both indoor and outdoor athletic events. Furthermore, they will not destructively intrude into the ground surface and thus damage it.

Deacon, et. al. (U.S. Pat. No. Des. 371,896) discloses an ornamental design for a golf shoe spike comprising a plurality of small bubble like protrusions depending from the lower surface of a conventional screw-in cleat. Although this design minimizes intrusion and resulting damage to sensitive turf materials This design also satisfies the requirement to provide a cleat that can be used on shoes in non-athletic activities, for example being worn in a club house. However, the cleat fails to develop sufficient torque and friction enhancement between the athletic (golf) shoe and the turf. Furthermore, because of the very large number and density of the bubble like protrusions, the surface of this cleat in contact with the turf presents itself much like an only slightly roughened (by the protuberances) flat surface. Consequently, necessary friction of the cleat in contact with the ground surface during athletic activity is generally insufficient and grass or other ground surfaces can not enter the spaces between cleats. Also, since the bubble like protrusions are directly attached to the bottom surface of the cleat, shear forces can dislodge the protrusions.

STATEMENT OF THE INVENTION

The present invention relates to a novel, improved, all purpose cleat comprised of a cleat body having a plurality of arcuate ribs extending from one edge of the periphery of the body of the cleat to the other edge forming a grid. A plurality of spaced nubs are mounted on the ribs, preferably on the intersection of two ribs, downwardly depend from the bottom surface; and a plurality of reinforcing ribs disposed between the nubs.

Cleats according to this invention can utilize grids other than rectangular. For example, the reinforcing ribs could be placed on a diagonal between the nubs where they would not only intersect with the nubs but also with each other, midway between the nubs.

The ribs provide reinforcement to the nubs, allowing them to flex without shearing or dislodging from the cleat. The matrix arrangement of spaced nubs increases traction, especially on grassy surfaces.

This invention provides a novel all purpose cleat that when incorporated into suitable footwear will increase traction of the shoe as demanded by many athletic activities. Additionally, the same cleated footwear is appropriate and practical for use outside a sports venue. While the nubbed cleats of this invention provide effective traction with ground surfaces typical of a broad variety of both indoor and outdoor athletic events, they will not destructively intrude into the surface and thus damage it.

This invention can be readily optimized for an extremely broad variety of applications and conditions by virtue of its flexible design not only with the geometry of its components but also by the judicious selection of material combinations. For example a more aggressive cleat can be provided by replacing the normal cylindrical nub configuration with a cone. The vertex of the cone provides a more aggressive contact surface with the terrain but with proper material selection, it will still not damage non-athletic surfaces. Similarly the normal essentially rectangular cross section of the grid can be changed to triangular thus also enhancing its interaction with ground surfaces. Again, by proper selection of materials, the blend of ground penetration and non-athletic surface interaction can be optimized.

In just one of its many applications, from utility, practicality and aesthetics perspectives, this invention provides a contemporary shoe that is light weight, attractively designed, may be formed from recyclable materials, and is utilitarian in that it can be effectively worn for normal, non-athletic use as well as for sporting activities.

A golfer using the nubbed cleats taught by this invention can wear the same shoes to and from the golf course, during golf play and in the club house. With these shoes, there is no need to change shoes because the nubbed cleats will not damage floors and carpets. Golf shoes incorporating these cleats also extend the effective playing season for a golfer by permitting play on fairways and greens during wet and even the cold dormant grass seasons. A further advantage of the athletic shoe incorporating this invention, is that the sports participant does not need to invest in extra pairs of shoes. The one pair of shoes, using the nubbed cleats of this invention, meets the multiple needs previously requiring more than one pair of shoes. These benefits accrue because the design of these cleats, incorporating a plurality of nubs and a grid of ribs formed from resilient, non abrasive materials, prevents damage to both manmade and natural materials while still developing the traction required for most athletic activities.

The nubbed cleats of this invention are also designed to improve the non-slip, non-skid performance of canes and walkers often used by the elderly and the infirm. Use of this novel device in such an application provides improved security for the user over a broad variety of terrains encountered outside the home and hospital. However, advantageously, the nubbed cleat retains its utility inside residences and hospitals without risk of damaging the interior floors and carpets.

As briefly mentioned earlier, it is also envisioned that this novel cleat will be employed for many applications other than footwear. A few illustrative examples include, placement at the bottom of furniture legs to minimize slippage on hardwood and composition floors, attachment to the base of equipment used in certain industrial applications where the equipment must be readily movable but stable when positioned for use, and applied to the tips of canes and walkers used by the elderly and infirm. Similarly this invention can be used on the bottom of common furniture "coasters" to provide non-slip advantages while simultaneously not harming the flooring surface.

This nubbed cleat, when used with footwear, may be formed integrally and simultaneously with the shoe outsole or the outsole can be separately formed with receptacles into which the cleats can later be incorporated. In the later construction, the cleats may be adhesively bonded to the outsole, the cleats may be threaded into a suitably designed cooperating threaded receptacle, or may be securely retained by the outsole via suitable interference design of the mating surfaces between the cleat and the receptacle and further enhanced by the elastomeric properties of outsole and the cleat.

Where an adhesive or bonding agent is not used to retain the nubbed cleats in the outsole, the cleats are replaceable by the wearer. Replacing the nubbed cleats extend the longevity of the shoe. Alternatively, cleats of a different configuration or material may be inserted to optimize shoe performance for various sporting activities, for specific terrains, or for changing weather conditions or for normal casual wear when walking on streets or at home.

Another method for fabricating an outsole is to form an outsole with cleat receiving receptacles into which cleat sets are subsequently installed. These cleat sets are comprised of a plurality of nubbed cleats secured to a substrate that properly aligns the nubbed cleats for receipt by the outsole and its cleat receiving receptacles. The periphery of each cleat can have a circumferential grove which mates with a cooperating ridge formed in the cleat receiving receptacles of the outsole. In this fashion the cleats are secured to the outsole.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
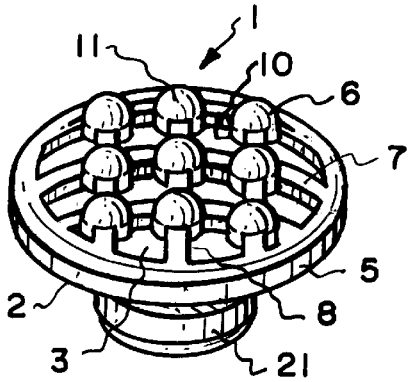
FIG. 1 is an perspective view of the all purpose nubbed cleat.
Figure 2:
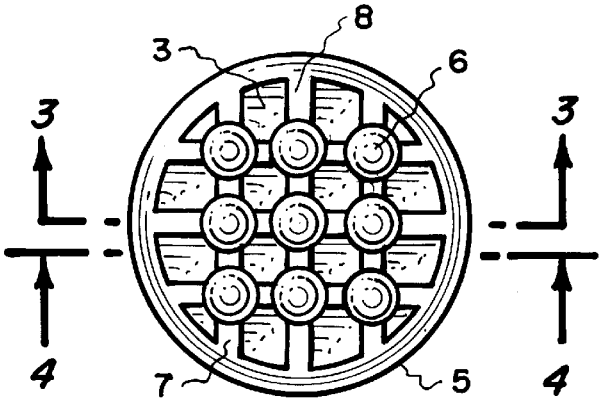
FIG. 2 is a plan view of the bottom surface of the all purpose nubbed cleat.

Referring now to FIG. 1, a nubbed cleat 1 according to the invention is illustrated as it might be configured for incorporation in an athletic shoe or as an independent non-slip, non-skid device for other applications, such as a cane tip. The nubbed cleat 1 comprises a cleat body 2, a bottom surface 3, a periphery 5, a plurality of downwardly depending nubs 6 connected at their upper ends 10 to the bottom surface 3 of cleat body 2, and a plurality of reinforcing ribs 7 disposed between nubs 6 and between the nubs 6 and the periphery 5. The rectangular grid 8 formed by the reinforcing ribs 7 is clearly shown in FIG. 2.

Figure 3:
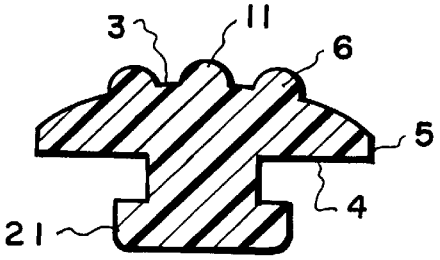
FIG. 3 is a section view taken along line 3—3 of FIG. 2 through the nubs of the all purpose nubbed cleat.
Figure 4:
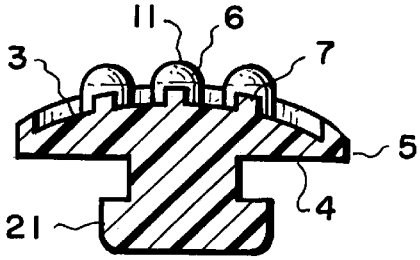
FIG. 4 is a section view taken along line 4—4 of FIG. 2 through the space between the nubs of the all purpose nubbed cleat.

FIGS. 1 and 3 illustrate the cylindrical cross section design of the nubs 6 and their rounded lower ends 11 as illustrated in the preferred embodiment. The shape of the rounded lower ends 11 of the nubs 6 is optimized for the development of traction with particularly sensitive ground surface materials, for example golf greens under excessively wet conditions. The nearly rectangular cross-section of the reinforcing ribs 7 is illustrated in FIG. 4

An elastomer is the presently preferred material for formation of the cleats. Desirable performance and manufacturing properties are achieved by use of natural or synthetic rubber and synthetic plastic resins, for example polyurethane, thermoplastic and ethyl vinyl acetate. The cleat materials are selected for their durability, abrasion resistance, traction developing characteristics, strength properties and of course manufacturability. For the application of this invention to shoes, and particularly athletic shoes, the cleat material may be the same, or different from the shoe outsole. Additionally the cleat itself may incorporate different materials with different strength properties for the cleat body 2, the nubs 6, and the reinforcing ribs 7. For example, the cleat body 2 and ribs 7 might be fabricated from rubber and the nubs 6 might be fabricated from a higher modulus polyurethane.

Figure 5:
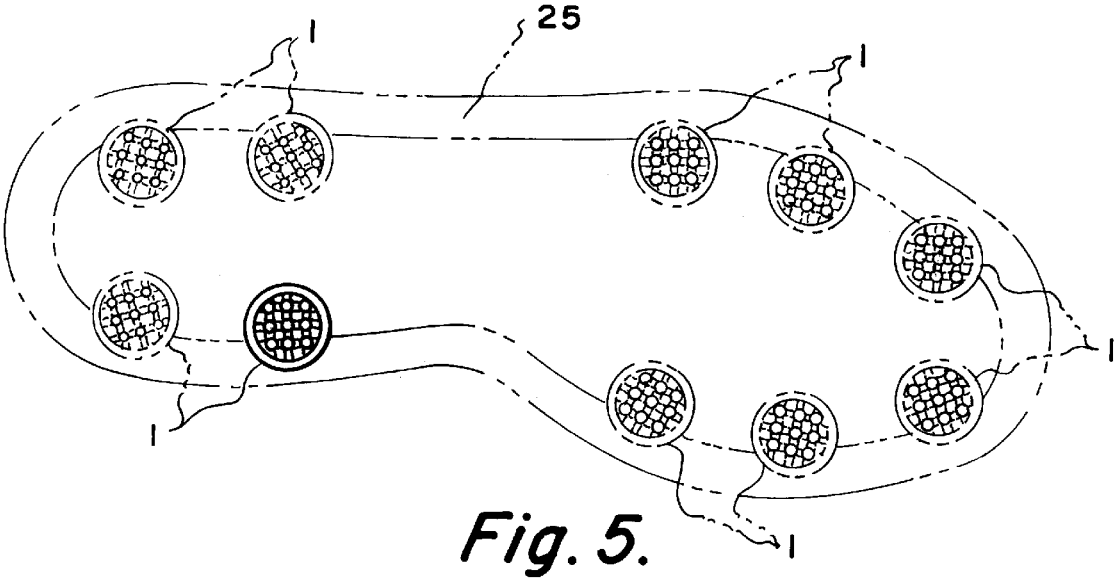
FIG. 5 shows a plurality of the all purpose nubbed cleats disposed on a shoe outsole as shown in dotted lines.
Figure 6:
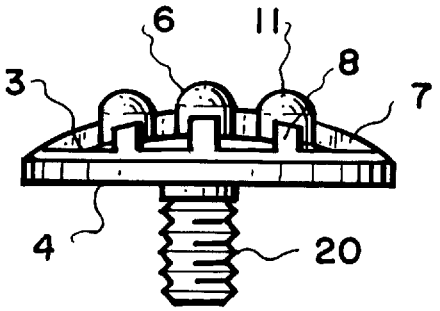
FIG. 6 shows a threaded means for attaching the nubbed cleat to a shoe outsole or other appliance.
Figure 7:
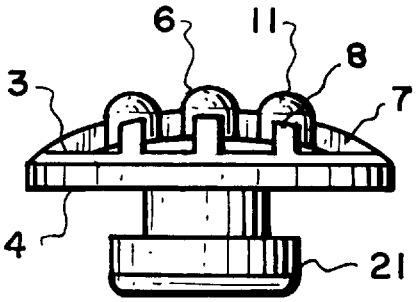
FIG. 7 shows a knobbed stub as the means for attaching the nubbed cleat to a shoe outsole or other appliance.

FIG. 5 depicts the application of this invention to a shoe outsole 25. FIGS. 6 and 7 illustrate two means for attaching the cleats 1 to a shoe outsole 25 or other appliance, one means is a threaded stud and the second comprises a knobbed stud.

Figure 8:
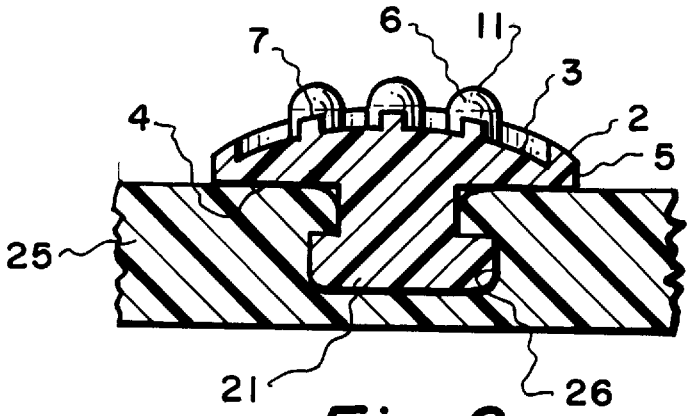
FIG. 8 depicts an all purpose nubbed cleat attached to a shoe outsole via a knobbed stud on the cleat and a cooperating snap-in receptacle in the shoe outsole.

The all purpose nubbed cleat 1 may be formed integrally with the shoe outsole 25. Alternatively, as shown in FIG. 8, the outsole 25 can be separately molded with snap-in receptacles 26 into which knobbed studs 21 attached to the upper surface 4 of nubbed cleats 1 can later be inserted. In the later construction, the knobbed studs 21 and upper surface 4 of cleats 1 may be adhesively bonded to the outsole 25. The cleats 1 may also be securely retained by the outsole 25 via suitable interference design of the mating surfaces between the knobbed stud 21 and the snap-in receptacle 26. The later attachment method is further enhanced by the elastomeric properties of the outsole and the cleat. Where an adhesive or bonding agent is not used to retain the cleats in the outsole, the cleats of this invention provide the additional advantage of being replaceable by the wearer.

Figure 9:
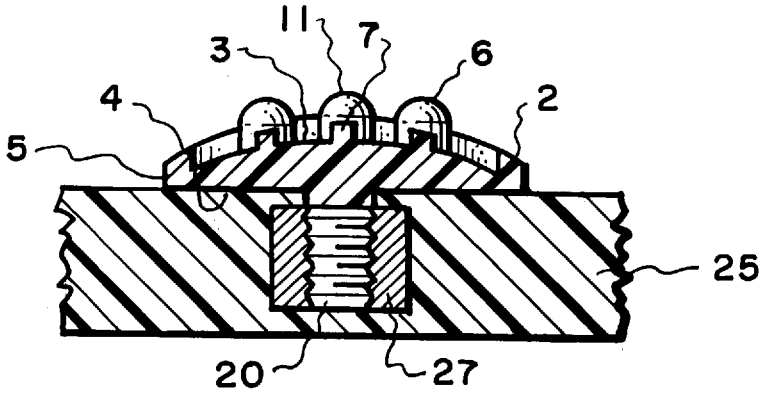
FIG. 9 depicts an all purpose nubbed cleat attached to a shoe outsole via a externally threaded stud on the cleat and an cooperating internally threaded receptacle in the shoe outsole.

FIG. 9 shows the upper surface 4 of cleat body 2 fitted with an externally threaded stud 20 so that the cleats may be replaced by threading into a cooperating internally threaded mating receptacle 27 in the shoe outsole.

It is to be realized that only preferred embodiments of this invention have been described, and that numerous substitutions, modifications, alterations, and applications are permissible without departing from the spirit and scope of the invention as defined in the following claims.

I claim:

1. An all purpose nubbed cleat comprising:

a cleat body having a top surface, a bottom surface and a periphery;

a plurality of parallel first rib attached to the bottom surface each extending in both directions to the periphery of the body, a plurality of parallel, second ribs attached to the bottom surface at an angle differing from the angle of the first ribs and extending in both directions to the periphery of the body whereby the ribs intersect, said first and second ribs having an arcuate convex bottom surface, a plurality of polygonal nubs having a first end and a second traction end, the first end of the nubs being mounted on said bottom surface and over said ribs whereby the portion of said ribs uncovered by nubs being disposed between said nubs and between said nubs and said periphery of said cleat body.

2. A nubbed cleat according to claim 1 in which in the bottom surface of the ribs are in the same arcuate plane.

3. A nubbed cleat according of claim 2 wherein said nubs are a right circular cylinder having an upper end secured to the bottom surface of the cleat body.

4. A nubbed cleat according to claim 3 wherein said nubs have a lower end that is rounded.

5. A nubbed cleat according to claim 1 wherein said second reinforcing ribs are perpendicular to the first reinforcing ribs forming a rectangular grid within the periphery of said cleat body.

6. A nubbed cleat according to claim 5 in which the nubs are mounted at the intersections of the first and second ribs.

7. A nubbed cleat according to claim 5 wherein said reinforcing ribs have an essentially rectangular cross section.

8. A nubbed cleat according to claim 1 wherein said cleat body, said nubs and said reinforcing ribs are each formed from a low abrasion synthetic organic resin.

9. A nubbed cleat according to claim 8 wherein the resin is an elastomer.

10. A nubbed cleat according to claim 9 wherein said cleat body, said nubs and said reinforcing ribs are each formed from the same elastomer.

11. A nubbed cleat according to claim 8 wherein said cleat body, said nubs and said reinforcing ribs are separately formed elastomers having different strength properties.

12. A nubbed cleat according to claim 11 wherein said nubs are formed from a higher strength material as compared to said reinforcing ribs whereby traction with the ground surface in enhanced.

13. A nubbed cleat according to claim 1 wherein said cleat is mechanically attached to a shoe outsole.

14. A method of fabricating an all purpose nubbed cleat comprising the steps of:

forming from a synthetic organic, elastomer resin a cleat body having a top surface, a bottom surface, a periphery, and a plurality of first parallel reinforcing ribs and a plurality of second, parallel reinforcing ribs both mounted on said bottom surface within said periphery the angle of the second ribs differing from the angle of the second ribs whereby the ribs intersect; and attaching a plurality of nubs to said ribs so as to downwardly depend from the bottom surface.

* * * * *